US006006574A

United States Patent [19]

Armenat et al.

[11] Patent Number: 6,006,574

[45] Date of Patent: Dec. 28, 1999

[54] APPARATUS AND METHOD FOR COOLING THE WORK ROLLS OF A ROLL STAND AT AN EXIT SIDE THEREOF

[75] Inventors: Jürgen Armenat; Martin Braun, both of Kreuztal, Germany

[73] Assignee: SMS Schloemann-Siemag Aktiengesellschaft, Düsseldorf, Germany

[21] Appl. No.: 09/140,908

[22] Filed: Aug. 27, 1998

[30] Foreign Application Priority Data

Aug. 29, 1997 [DE] Germany ..... 197 37 735

[51] Int. Cl.[6] ..... B21B 27/06

[52] U.S. Cl. ..... 72/201; 72/200

[58] Field of Search ..... 72/208, 209, 214, 72/252.5; 492/1, 30, 45; 403/381, 383

[56] References Cited

U.S. PATENT DOCUMENTS

| | | | |
|---|---|---|---|
| 5,067,199 | 11/1991 | Alazet | 15/320 |
| 5,473,924 | 12/1995 | Collinson | 72/236 |
| 5,553,469 | 9/1996 | Seidel | 72/201 |

FOREIGN PATENT DOCUMENTS

| | | |
|---|---|---|
| 3616070 | 12/1986 | Germany . |
| 0105 7908 | 3/1989 | Japan . |
| 0109 1903 | 4/1989 | Japan . |
| 0633 9712 | 12/1994 | Japan . |

*Primary Examiner*—Rodney Butler
*Attorney, Agent, or Firm*—Friedrich Kueffner

[57] ABSTRACT

An apparatus for cooling the work rolls of a roll stand includes for each roll a cooling water duct equipped with spray nozzles at a spray beam as well as devices for supplying cooling water and for removing heated water, a cooling water guide plate for the upper work roll arranged at an acute angle relative to the rolling stock surface and provided with a stripping member at the front of the guide plate facing the upper roll, and an essentially horizontally extending cooling water guide plate located closely underneath the rolling stock plane and provided with a stripping member for the lower roll. A cover plate is arranged in a sandwich-type configuration above the upper cooling water guide plate so as to form a liquid-conducting gap and the gap is connected at its end facing away from the roll with a cooling water suction device, and at least one suction pipe is arranged underneath the lower cooling water guide plate, wherein the suction pipe extends into the liquid-conducting corner area formed between the lower cooling water guide plate and the stripping member thereof and a surface portion of the lower roll, and wherein the suction pipe is connected to a cooling water suction device.

9 Claims, 2 Drawing Sheets

APPARATUS AND METHOD FOR COOLING THE WORK ROLLS OF A ROLL STAND AT AN EXIT SIDE THEREOF

BACKGROUND OF THE INVENTION

1. Field of the Invention

The present invention relates to an apparatus for cooling the work rolls of a roll stand, wherein the apparatus includes for each roll a cooling water duct equipped with spray nozzles at a spray beam as well as means for supplying cooling water and for removing heated water, a cooling water guide plate for the upper work roll arranged at an acute angle relative to the rolling stock surface and provided with a stripping member at the front of the guide plate facing the upper roll, and an essentially horizontally extending cooling water guide plate located closely underneath the rolling stock plane and provided with a stripping member for the lower roll.

The present invention also relates to a method for cooling the work rolls using the apparatus described above.

2. Description of the Related Art

Apparatus and methods for cooling the work rolls of roll stands are known in the art. Usually, a cooling unit each is provided on the entry side and on the exit side. Even though requiring a large and complicated apparatus, the effect of the work roll cooling unit on the entry side is relatively small.

The requirement of an effective work roll cooling results from the objects to be achieved in connection with the rolling process; these objects are:

preventing a defined temperature limit from being exceeded in order to maintain the mechanical properties of the work rolls;

limiting the thermal stresses in the work rolls and, thus, preventing fractures in the work rolls;

minimizing fire cracks in the surface of the work rolls;

positively influencing the oxidation film on the work rolls, particularly in chromium steel rolls.

Most of the heat is produced during the contact of the work rolls with the rolling stock in the roll gap; this is increased by the additionally developed rolling heat produced as a result of the plastic changes of the shape of the rolling stock and further by the frictional heat produced between the rolling stock and the rolls and the introduction of the frictional heat in the contact area between the work roll and the back-up roll and additional heating by the radiation heat in the entry area and in the exit area.

For achieving sufficient roll cooling, the influence of the cooling unit on the exit side is of particular importance because the heat induced to the surface area of a roll must be removed as early as possible after leaving the roll gap in order to prevent the heat from penetrating into the depth of the roll as much as possible and as efficiently as possible.

DE 36 16 070 A1 discloses a roll cooling apparatus for a roll stand which includes cooling water guide plates which each have a curved surface along the circumferential direction of a roll and are arranged near the respective roll, further a cooling water supply distributor for supplying the cooling water in a cooling water duct which is defined by the cooling water guide plate and the roll, a water discharge distributor for discharging the cooling water from the cooling duct and supplied by the cooling water supply distributor, a support element for supporting the cooling water guide plate and curvature adjusting members which change the curvature of the guide plate in accordance with the diameter of the roll.

The thickness of the guide plate increases from the edge portions to the middle of the guide plate in the circumferential direction of the roll. When the roll diameter is changed the curvature adjusting members serve to maintain the space available between the guide plate and the roll to the necessary extent so that the roll is sufficiently cooled. This apparatus produces a forced cooling water guide means whose configuration corresponds to the outer circumference of a roll, wherein the uniform distance relative to the roll produces an intermediate space between the cooling water guide means and the roll through which the cooling water is conveyed under pressure, which is supposed to achieve an average heat transfer number which is about four times the value of the conventional heat transfer number.

This known apparatus is technically very complicated and, in addition, the curvature adjusting members are arranged in such a way that they are not easily accessible and, moreover, the periodic readjustment of the curvature requires a high degree of maintenance work. Since, in addition, the cooling medium is conducted in a forced manner in a narrow gap along a portion of the roll surface, the cooling medium absorbs heat as it travels through the gap and looses its cooling intensity to the same extent.

The Japanese Patent Application published under the number 01091903 A discloses an apparatus for cooling the work rolls on the exit side with upper and lower cooling water guide plates provided with stripping members, wherein each cooling water guide plate is equipped at the end facing the work roll with spray nozzles for a cooling water and air mixture. By spraying a water mist into the corner areas between the work rolls and the rolling stock forming an acute angle on the exit side, a sufficient cooling effect is supposed to be achieved at the work rolls and the consumption of cooling water is simultaneously to be reduced.

The Japanese Patent Application published under number 01057908 A discloses water mist nozzles at the front side of cooling water guide plates, and additional upper and lower spray nozzles for cooling water. This apparatus is supposed to prevent the formation of cracks at the surface of the work rolls.

The Japanese Patent Application published under number 06339712 A discloses a cooling apparatus on the exit side for work rolls each with cooling water ducts arranged three-high above or below each other and equipped with spray nozzles, and with an upper and a lower cooling water guide plate with a stripping member at the end thereof. The upper guide plate is provided at a distance from the upper roll with a duct arranged parallel to the axis of the roll and provided with openings for cooling water to be discharged, wherein the duct forms a cooling water discharge duct which is open at both ends. This is supposed to achieve a discharge of heated cooling water from the middle portion of the work rolls uniformly to both sides. However, since the heated cooling water flows in this device only with natural gradient and through the relatively narrow duct cross-section from the middle toward both sides, the liquid throughput is relatively small and cannot be increased as desired.

The water level is adjusted between the upper cooling water guide plate and a lower portion of the upper work roll approximately on the level of the inlet openings of the discharge duct. In this construction the application of a negative pressure would only result in the intake of air, but not in an increased removal of liquid. Moreover, in this device it is also not possible to provide different discharge quantities of liquid in different areas of the discharge duct and in a direction extending parallel to the axis of the rolls which would mean that the formation of a predetermined thermal crown could be influenced. A discharge device for cooling water running off the lower work roll is not provided.

SUMMARY OF THE INVENTION

Starting from the prior art discussed above, it is the primary object of the present invention to further develop an apparatus and a method for cooling the work rolls of a roll stand of the above-described type, and to improve the apparatus and the method in such a way that the difficulties and technical limits described above are overcome, wherein the influence especially of the cooling on the exit side on the thermal behavior of the work rolls is optimized and the heat can be removed from the roll surface as early as possible in order to reduce as much as possible the penetration of the heat into the depth of the work rolls and, moreover, to influence the zone-by-zone formation of the thermal crown along the axis of the rolls by a zone-by-zone forced removal of the cooling water.

In accordance with the present invention, a cover plate is arranged in a sandwich-type configuration above the upper cooling water guide plate so as to form a liquid-conducting gap and the gap is connected at its end facing away from the roll with a cooling water suction means, and at least one suction pipe is arranged underneath the lower cooling water guide plate, wherein the suction pipe extends into the liquid-conducting corner area formed between the lower cooling water guide plate and the stripping member thereof and a surface portion of the lower roll, and wherein the suction pipe is connected to a cooling water suction means.

As a result of the formation of a liquid-conducting gap and the connection of the gap to a powerful cooling water suction means for the upper work roll and the arrangement of suction pipes in the liquid-conducting corner area formed between the lower cooling water guide plate and a surface portion of the lower roll and the connection of the suction pipes to a powerful cooling water suction means, the apparatus according to the present invention makes possible a significant optimization of the discharge conditions of the "used" cooling water by a pressure drop which is artificially increased by negative pressure. This provides the possibility of controlling within wide limits the discharge of the cooling water, for example, by connecting the discharge members according to the present invention to the suction side of powerful pumps. This further results in an advantageous possibility of increasing the cooling effect by the forced removal of used cooling water on the exit side of the rolls to such an extent that the arrangement of a work roll cooling unit on the entry side is not necessary, which significantly reduces the costs and provides space for mounting new technologies on the inlet side of the work rolls, such as, for example, roll gap lubrication, in-line grinding systems, measuring systems, etc.

In accordance with a further development of the present invention, the liquid-conducting gap may be divided into at least three parallel duct portions, i.e. a side duct portion, a middle duct portion and another side duct portion, wherein each of these duct portions has a predetermined extension and is provided with an individual cooling water suction means. This makes it possible within predetermined limits to influence the cooling effect on work rolls as seen in axial direction, so that the thermal crown can be influenced in the desired manner.

A method for the cooling of the work rolls of a roll stand on the exit side includes removing water collecting after the heat exchange with the rolls in an intake area in front of the intake portion of the gap, on the one hand, and, on the other hand, removing water in the corner area between the lower work roll and the corresponding cooling water guide plate by applying a negative pressure forming an upper and a lower cooling water suction means.

In the method according to the present invention it is further provided that the cooling water suction means are divided into a number of suction areas over the axial extension of the work rolls and are provided with different suction lines.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
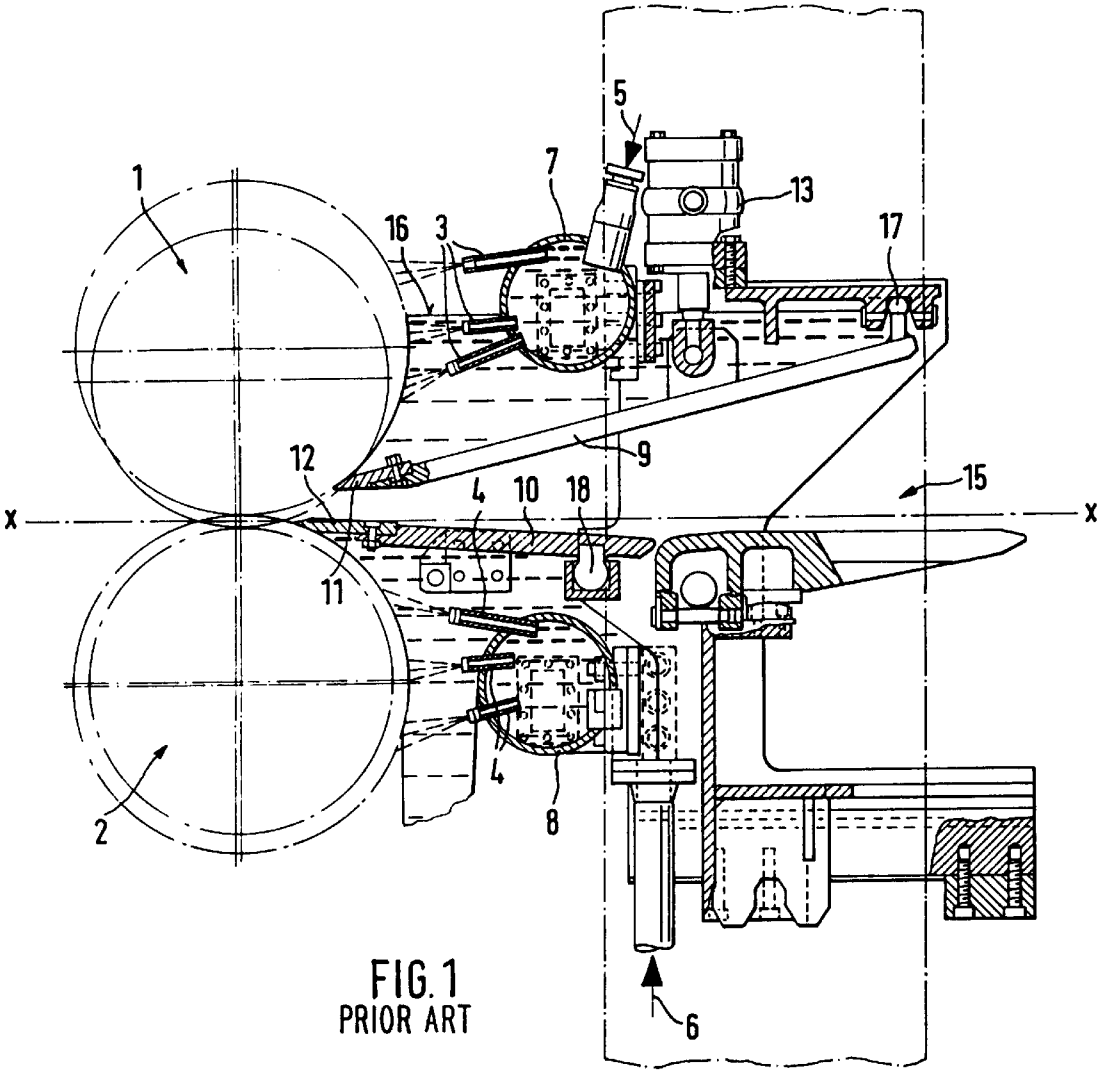
FIG. 1 PRIOR ART
FIG. 1 is a side view, partially in section, of an apparatus for cooling the work rolls of a roll stand on the exit side in accordance with the prior art.

FIG. 1 shows an apparatus for cooling the work rolls 1, 2 on the exit side of a roll stand 1S, not shown in detail. The apparatus includes for each roll a cooling water duct equipped with spray nozzles 3, 4 on a vertically adjustable spray beam 7, 8. The apparatus includes means 5, 6 for supplying cooling water. Means for an ordered removal of heated water are not provided in this construction. The rolling line is indicated in a dash-dot line with x—x. Provided for the upper work roll 1 and extending at an acute angle relative to the rolling stock surface is a cooling water guide plate 9 with a stripping member 11 at the front end thereof which contacts the roll 1.

Provided closely underneath the rolling stock plane x—x is an also approximately horizontally extending cooling water guide plate 10 with a stripping member 12 contacting the lower roll 2. On the end facing away from the work roll 1 the upper cooling water guide plate 9 is mounted in a universal joint 17 and is moved with a force application means, for example a pneumatic cylinder 13, with the stripping member 11 approximately tangentially against the upper work roll 1 under a predetermined force. At an end facing away from the work roll 2, the lower cooling water guide plate 10 is mounted in a joint 18 and is held with the stripping member 12 in a stripping position, for example, under the influence of its own weight.

As indicated by the areas provided with dark shading, cooling water which flows off can back up to a level 16 which significantly impairs the formation of free spray jets 3 and 4, on the one hand, and prevents the water from flowing off quickly enough, on the other hand. This is particularly true for the upper cooling unit because the stripping member 11 with the upper cooling water guide plate 9 prevents the liquid from unimpededly flowing downwardly. Experience has further shown that the water at the lower work roll cooling unit can also not flow off unimpededly. The water may be backed up which may have the result that, for example, the lower stripping member on the exit side is raised.

This results in the disadvantage that the fresh cooling liquid cannot reach the rolls 1, 2 unimpededly. Consequently the cooling liquid is sprayed into the backed-up water which means that a cooling effect is achieved which is reduced as compared to when water is directly sprayed against the rolls.

Figure 2:
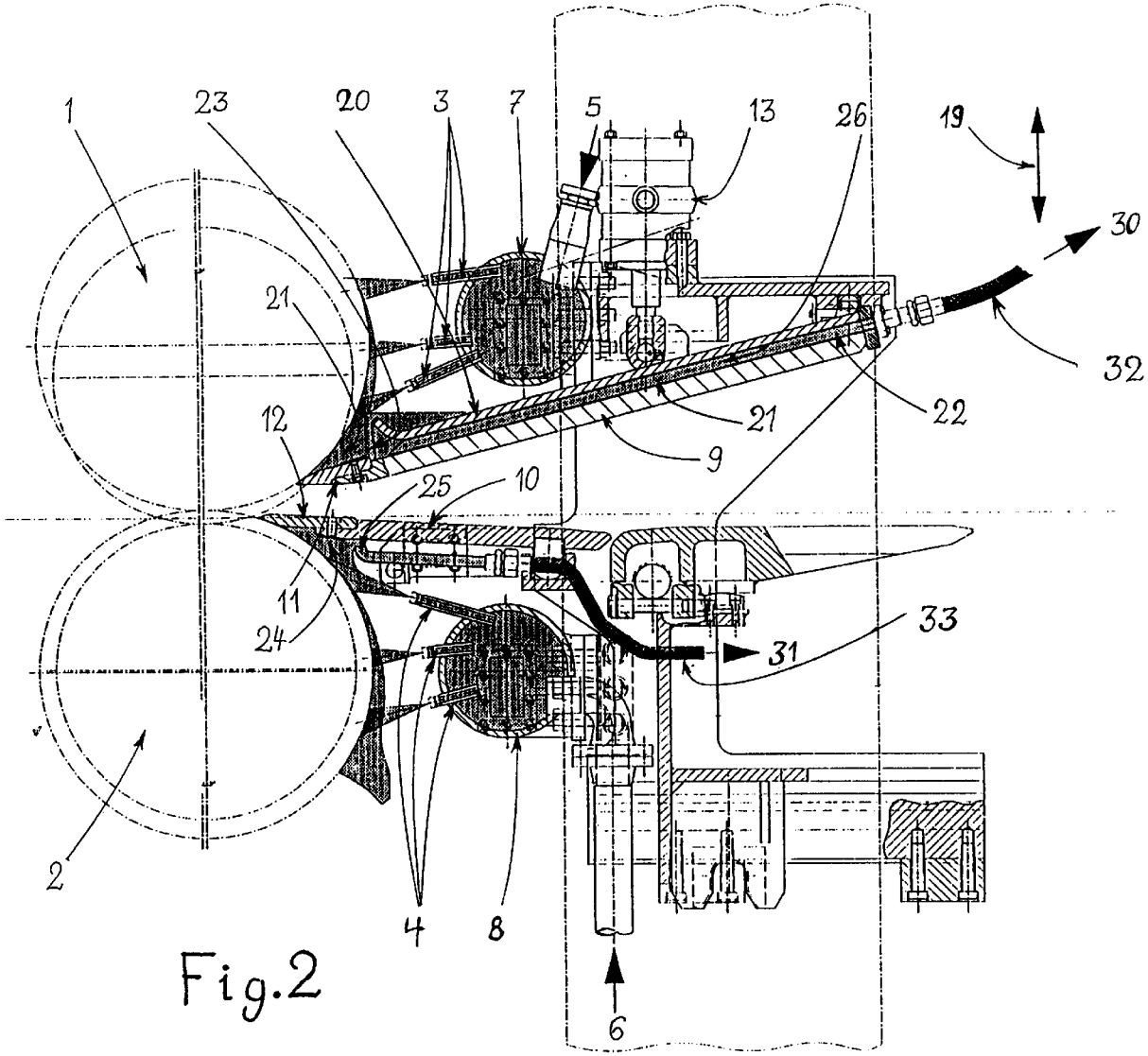
FIG. 2 is a side view, partially in section, of an apparatus for cooling the work rolls of a roll stand on the exit side in accordance with the present invention.

FIG. 2 of the drawing shows the apparatus for cooling the work rolls 1, 2 on the exit side of the work rolls according to the present invention. The same functional elements are provided with the same reference numerals.

The apparatus according to the present invention meets the above-mentioned objects by arranging a cover plate 20 in a sandwich-type configuration above the upper cooling water guide plate 9 so as to form a liquid-conducting gap 21. The gap 21 is at its end 22 facing away from the roll 1 in connection with a cooling water suction means 30.

At least one suction pipe 25 is arranged underneath the lower cooling water guide plate 10 so as to extend into the liquid-conducting corner area 24 formed between the cooling water guide plate 10 with its stripping member 12 and a surface portion of the lower roll 2, wherein the at least one suction pipe 25 is connected to a cooling water suction means 31.

The technical advantage of the embodiment of FIG. 2 is essentially the fact that the stripping plate 9 is constructed in a sandwich-type construction and the cooling beam is vertically adjustable in dependence on the actual work roll diameter and the roll gap in accordance with the double arrow 19. The gap 21 resulting from the sandwich-type construction is now utilized as a suction duct for the used cooling liquid. This provides the following advantages:

the fresh cooling liquid acts directly on the work roll 1 and, thus, only a thin liquid film must be penetrated by the impulse of the spray jets;

the spray beam can be arranged at a lower location, i.e., closer to the roll gap x—x;

due to the effect of the suction means 30, cooling liquid is conducted past the roll 1 with a forced speed; this leads to a significant increase of the heat transfer number and, thus, to an improvement of the cooling effect;

a smaller quantity of water flows off in an undefined manner, so that less water flows around wear plates of the lower back-up roll chocks; the grease layer present at this location is maintained for a longer period of time so that the corrosion of the wear plates is significantly reduced.

Underneath the stripping member 12 as well as the lower cooling water guide plate 10, the arrangement of the suction duct 25 leads to a substantial reduction of the cooling water quantity flowing off in an undefined manner. This provides the same advantages as the ones described above in connection with the upper cooling water suction means 30. For example, suctioning can be carried out for each roll stand with a vertical submerged pump in dry placement, wherein the pump is also suitable for sipping-type operation. Alternatively, it is possible to arrange several individual pumps for each spray beam. This produces the advantage that, in dependence on the width of the roll body, different volumetric flows can be suctioned off and, thus, the thermal crown of the work rolls 1, 2 can be influenced.

In its area facing the roll 1, the cover plate 20 is bent upwardly so as to form a suction portion 23 at the inlet area of the gap 21 which provides favorable flow conditions- This makes it possible to achieve very advantageous flow conditions in the withdrawal of the discharged cooling water.

Advantageous flow conditions can be achieved in a very uncomplicated manner in the case of the lower work roll by bending the suction pipe or pipes 25 upwardly in the area of the intake openings thereof.

In accordance with another possible feature, at least the suction portion 23 providing the advantageous flow conditions of the liquid-conducting gap corresponds to the axial extension of the roll 1 and the liquid-conducting gap 21 is closed on its transverse sides so as to form at least one duct 26.

In addition, the cooling water suction means 30, 31 may each be connected with a plurality of flexible hoses 32, 33 to the suction side of at least one pump.

In order to make it possible to suction off different volumetric flows in dependence on the roll body width, so that the thermal crown of the work rolls 1, 2 can be influenced, another feature provides that the liquid-conducting gap 21 is divided by longitudinal walls into at least three parallel duct portions, i.e., a side duct portion, a middle duct portion, and another side duct portion, and that each of these duct portions has a predetermined axial extension and is provided with an individual cooling suction means.

The cooling water suction means 31 of the lower work roll 2 may also have a plurality of suction pipes 25 arranged along the axial extension of the roll wherein each suction pipe 25 is connected to an individual cooling water suction means.

During operation of the apparatus, cooling water is removed in a defined manner after the heat exchange with the rolls 1, 2 by applying a negative pressure with an upper and a lower cooling water suction means 30, 31 in the inlet area in front of the suction portion 23 of the gap 21, on the one hand, and in the corner area 24 between the lower work roll 2 and the corresponding cooling water guide plate 10. The cooling water suction means 30, 31 are divided over the axial extension of the work rolls 1, 2 into a number of suction areas and are provided with different suction powers.

While specific embodiments of the invention have been shown and described in detail to illustrate the inventive principles, it will be understood that the invention may be embodied otherwise without departing from such principles.

We claim:

1. An apparatus for cooling an upper work roll and a lower work roll of a roll stand, the apparatus comprising for each of the rolls a cooling water duct equipped with spray nozzles on a spray beam and means for supplying cooling water and for discharging heated water, an upper cooling water guide plate extending at an acute angle relative to a rolling stock surface and having a stripping member mounted at an end of the guide plate facing the upper work roll, and an essentially horizontally extending lower cooling water guide plate located closely below a rolling stock plane and having a stripping member at an end of the lower guide plate facing the lower work roll, further comprising a cover plate extending parallel to and above the upper cooling water guide plate so as to form a liquid-conducting gap therebetween, wherein the gap is at an end facing away from the upper work roll connected to a cooling water suction means, and wherein the cover plate has an upwardly bent end facing the upper work roll so as to form a suction portion at an inlet area of the gap, and at least one suction pipe arranged underneath the lower cooling water guide plate and extending into a liquid-conducting corner area defined between the lower cooling water guide plate and the stripping member thereof and a surface portion of the work roll.

2. The apparatus according to claim 1, wherein the apparatus is mounted on an exit side of the work rolls.

3. The apparatus according to claim 1, wherein the at least one suction pipe is bent upwardly in an area of an intake opening thereof.

4. The apparatus according to claim 1, wherein at least the suction area of the liquid-conducting gap corresponds to the axial extension of the roll.

5. The apparatus according to claim 1, wherein the liquid-conducting gap has closed transverse sides so as to form a duct.

6. The apparatus according to claim 1, wherein the cooling water suction means are each connected with a plurality of flexible hoses to a suction side of at least one pump.

7. A method of cooling an upper work roll and a lower work roll of a roll stand, the roll stand including for each of the rolls a cooling water duct equipped with spray nozzles on a spray beam and means for supplying cooling water and for discharging heated water, an upper cooling water guide plate extending at an acute angle relative to a rolling stock surface and having a stripping member mounted at an end of the guide plate facing the upper work roll, and an essentially horizontally extending lower cooling water guide plate located closely below a rolling stock plane and having a stripping member at an end of the lower guide plate facing the lower work roll, the method comprising suctioning off water on an exit side of the work rolls after a heat exchange with the work rolls by applying a negative pressure by an upper cooling water suction means in an inlet area in front of an intake portion of a gap defined between the upper cooling water guide plate and a cover plate mounted parallel to and above the upper cooling water guide plate and by a lower cooling water suction means in a corner area between the lower work roll and the lower cooling guide plate, the method further comprising carrying out suctioning off for the roll stand by means of at least one vertical submerged pump in dry placement which is also suitable for sipping-type operation.

8. The method according to claim 7, comprising dividing the cooling water suction means into a plurality of suction areas along the axial extension of the work rolls, and providing each suction area with different suction powers.

9. The method according to claim 7, comprising vertically adjusting the spray beam of each roll with the cooling water duct independently of the stripping member and the cooling water guide plate in dependence on an actual work roll diameter and roll gap width.

* * * * *